United States Patent [19]

Reiner et al.

[11] 4,439,648

[45] Mar. 27, 1984

[54] JOYSTICK-TYPE CONTROLLER

[75] Inventors: Norbert L. Reiner, Wallingford; Stephen M. Sledesky, East Hartford, both of Conn.

[73] Assignee: Coleco Industries, Inc., Hartford, Conn.

[21] Appl. No.: 402,435

[22] Filed: Jul. 28, 1982

[51] Int. Cl.[3] ..... H01H 25/04

[52] U.S. Cl. ..... 200/6 A; 200/288; 200/329

[58] Field of Search ..... 200/6 A, 5 A, 339, 159 B, 200/292, 329, 335, 288; 273/85 G

[56] References Cited

U.S. PATENT DOCUMENTS

| | | | |
|---|---|---|---|
| 4,091,234 | 5/1978 | Bristow | 178/18 |
| 4,124,787 | 11/1978 | Aamoth et al. | 200/6 A |
| 4,148,014 | 4/1979 | Burson | 340/709 |
| 4,275,611 | 6/1981 | Asher | 74/471 X |
| 4,319,099 | 3/1982 | Asher | 200/302 X |

FOREIGN PATENT DOCUMENTS

| | | | |
|---|---|---|---|
| 148123 | 5/1981 | German Democratic Rep. | 200/159 B |

*Primary Examiner*—E. A. Goldberg
*Assistant Examiner*—Morris Ginsburg

[57] ABSTRACT

A joystick controller assembly for making switch closures in response to X-Y coordinate movements of a joystick in which means are provided for limiting the force which can be applied to a switch.

5 Claims, 4 Drawing Figures

JOYSTICK-TYPE CONTROLLER

FIELD OF THE INVENTION

This invention relates to manually operated controller assemblies for generating switch closures in response to X-Y coordinate movements of a member, such as a joystick and is particularly useful in conjunction with manipulation of images or markers on a video display.

BACKGROUND OF THE INVENTION

Most video games employ a so-called joystick for purposes of generating switch closures in order to control directional movement of an object displayed on the video screen. Generally, such controllers comprise a lever or stick positioned upon a pivot providing means which serves to axially support the handle for movement in an arc in directions radially of the axis of the handle. A substrate carries a plurality of pressure-activated switches disposed in a predetermined pattern about the axis of the handle. Dependent upon the construction of the switch actuating means operated by the handle, excessive pressure can be applied to a contact on the substrate. If such excessive pressure is repeatedly applied, it is possible that a contact such as a rivet could be loosened and lose electrical contact with a circuit path printed or otherwise defined on the substrate. Repetitive application of excessive pressure could damage any type of switching mechanism utilized to sense the direction of tilt or movement of the handle. Known joystick controllers are represented by U.S. Pat. Nos. 4,124,787 and 4,319,099.

SUMMARY OF THE INVENTION

Briefly stated, the invention in one form thereof, is embodied in a video game controller which comprises a joystick or a handle member extending through the top wall of a housing member which supports a substrate therein. Electrical circuits, or portions thereof, are defined on the substrate. The handle member has a radially extending annular flange, which is biased downwardly from the top wall of the cover member. The handle is partially hollow and is supported on a pivot providing member for tilting movement radially of the axis of the handle. A plurality of pressure responsive switches are positioned on the substrate in predetermined angular pattern about the axis of the handle and located beneath the handle flange so that one or more of the switches may be operated by the flange upon tilting of the handle. The handle flange has a downwardly projecting annular shoulder adapted to actuate the switches. An annular member having a plurality of cantilevered arms is disposed about the pivot providing means with the arms positioned over each switch. Projecting downwardly from the annular member, in radial alignment with each arm, are stops designed to engage the substrate and transmit the force of the handle flange to the substrate if excessive force is attempted to be applied to a switch through one of the cantilevered arms. Preferably, the pivot providing member and the annular member with the cantilevered arms are formed integrally.

An object of this invention is to provide a new and improved X-Y coordinate controller of the joystick type.

Another object of this invention is to provide an X-Y coordinate controller of the joystick type having new and improved means for limiting the amount of force that can be applied to a switch or a switching contact.

The features of the invention which are believed to be novel are particularly pointed out and distinctly claimed in the concluding portion of the Specification. The invention, however, together with further objects and advantages thereof, may best be appreciated by reference to the following detailed description taken in conjunction with the drawings.

DETAILED DESCRIPTION OF THE INVENTION

Figure 2:
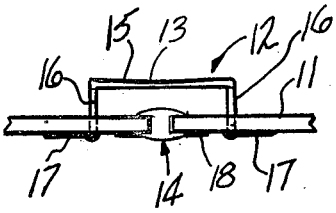
FIG. 2 is an enlarged side view of one of the switching elements on substrate 11.
Figure 1:
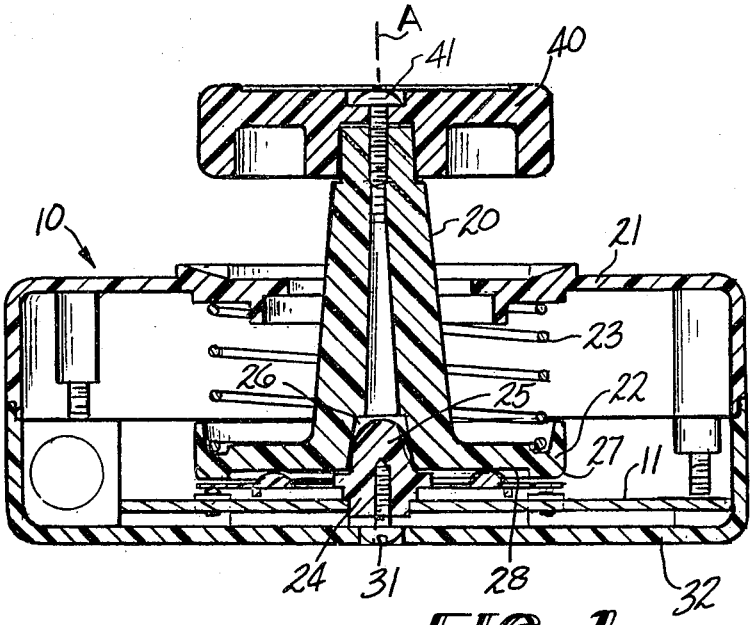
FIG. 1 is a half-section in elevation of a device embodying the invention.

The invention may be embodied in an X-Y coordinate controller assembly which is disposed in a housing 10, having a substrate 11 supported therein, with electric circuits or partial electric circuit patterns defined thereon. Mounted to substrate 11 are a plurality of switches 12, which are shown in FIG. 2, comprise upper and lower contact elements 13 and 14, respectively. The upper switching element 13 has an upper bridging member 15 and legs 16 extending through substrate 11 for connection to conductors 17 on the underside of substrate 11. Contact 14 which may be in the form of a rivet is connected to a conductor 18. In operation, when pressure is applied to the bridging portion 15 of element 12, the side legs 16 expand slightly and then the bridging portion 15 snaps against contact 14 to close an electrical circuit and maintain it closed so long as pressure is maintained on portion 15. When pressure is removed, portion 15 will snap upwardly.

A handle member 20 extends into housing 10 through upper wall 21 thereof and includes a lower annular flange 22, which defines a seat thereon for a helical spring 23. Spring 23 biases handle 20 downwardly and into contact with a member 24 secured to housing 11 and having an upwardly extending pivot portion 25. Pivot portion is substantially semi-elliptical in cross-section. Handle 20 has a frustro-conical recess 26 which receives pivot portion 25 therein and will permit tilting movement of handle 20 in any radial direction with respect to the axis of pivot portion 25, which coincides with the longitudinal axis A of handle 20. Flange 22 has a lower annular boss or shoulder 27 defined thereon adjacent the perimeter thereof which overlies the switches 12. Handle 20 also has a lower annular planar surface 28.

Figure 3:
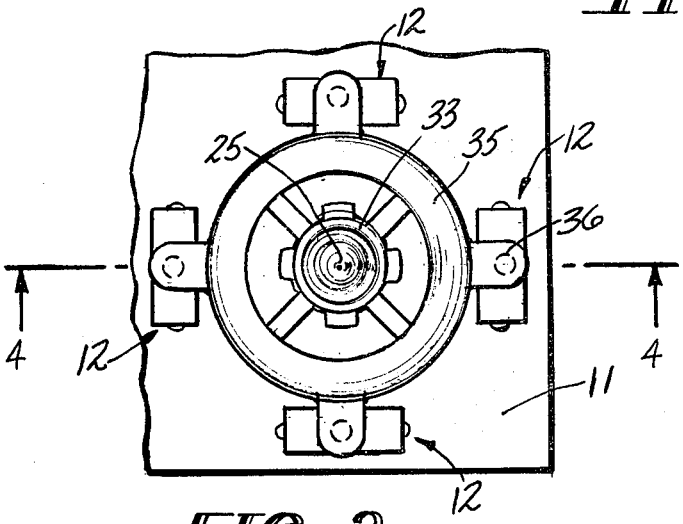
FIG. 3 is a top plan view of a pivot providing member of FIG. 1.
Figure 4:
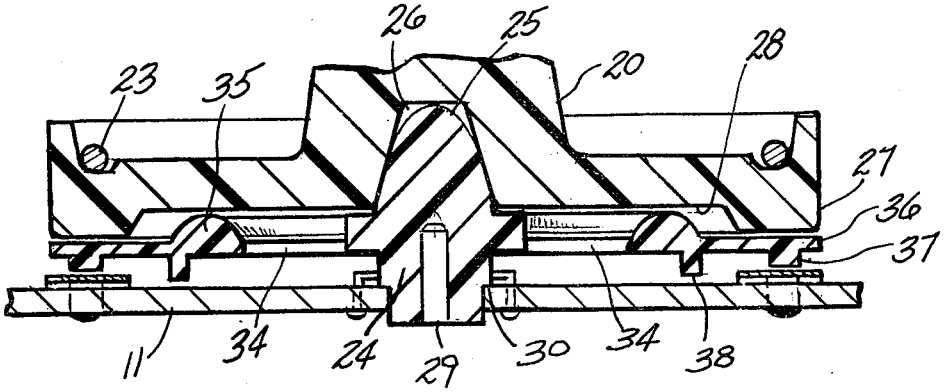
FIG. 4 is a sectional view seen in the plane of lines 4—4 of FIG. 3.

Reference is now made to FIGS. 3 and 4. Member 24 has a lower rectangular portion 29 which extends through substrate 11, with a small shoulder 30 thereabove to position member 24 with respect to substrate 11. A screw 31 extending through the bottom wall 32 of housing 10 secures member 24 thereto. A plurality of connecting arms 34 extend from a central portion 33 of member 24 to an annular portion 35. The connecting arms 34 are angularly intermediate the switches 12 to facilitate tilting of annular portion 35 toward a switch 12. A plurality of arms 36 are cantilevered from annular portion 35 over switches 12. Each arm has a projection 37 thereon overlying a switch 12. A stop 38, radially aligned with each of projections 37, extends downwardly from annular member 35.

The thickness of the elements of member 24 will determine their flexibility. The central portion 33 and pivot portion 25 are almost inflexible. The dimensioning of the thickness of arms 34 permits annular portion 35 to be tilted with respect to central portion 33. The relative thinness of the arms 36 and the cantilevering thereof from annular portion 35 permit relatively easy flexing of arms 36 with respect to annular portion 35.

In operation, when handle 20 is tilted to close a switch 12, ring 27 on flange 22 will engage an arm 36 and bend it downwardly from annular portion 35 on to a switch 12 until switch closure occurs. During this operation annular portion 35 will tilt slightly due to flexing of arms 34. If excessive pressure is applied, the undersurface 28 of flange 27 will engage the upper arcuate surface of annular portion 35 radially adjacent the closed switch and force it downwardly until the stop 38 radially adjacent the closed switch bottoms on substrate 11 and transfers any further pressure from flange 22 directly to the substrate. When a stop 38 bottoms on substrate 11, it prevents further pressure from being applied to its associated switch.

A finger knob 40 is affixed to handle 20 as by means of a screw 41. An operator may manipulate the handle 20 and tilt it radially of pivot 25. When the handle 20 is thus manipulated, shoulder 27 will actuate one or more switches 12 and make contact between the elements 13 and 14. If the ring 27 of flange 22 is operated directly on to the switches, possible damage could occur to the switches due to excessive pressure. For example, in the type of switch shown, the contact 14 could be loosened with respect to circuit pattern 18, resulting in intermittent, or no contact. If other types of switches were used, excessive pressure could cause damage to switch types other than that shown.

It may thus be seen that the objects of the invention are efficiently attained. Since certain features of the invention may be changed, as for example, the type of switches, and other modifications may become apparent to one skilled in the art, it is intended that the appended claims cover all modifications and embodiments of the invention which do not depart from the spirit and scope thereof.

Having thus described the invention, what is claimed is:

1. A controller for causing switch contact closures in response to X-Y coordinate movements, said controller comprising a housing, a substrate including an electrical circuit defined thereon supported in said housing, a handle having a longitudinal axis extending into said housing and having a lower annular flange extending radially therefrom, means in said housing supporting said handle thereon for pivotal movement radially of the axis of said handle, a plurality of switch contacts on said substrate and positioned in a predetermined angular pattern about the axis of said handle, said contacts being located on said substrate beneath said flange so that one of said contacts may be operated by said flange by tilt of said handle, a member having a plurality of cantilevered flexible arms extending between said contacts and said flange whereby tilting motion of said handle may cause said arms to engage one of said contacts, projections on said member, each projection associated with one of said arms and extending downwardly toward said substrate radially inwardly of the extremities of each of said arms, whereby when said handle is tilted to close one of said contacts after predetermined movement of one of said arms, the associated projection will bottom on said substrate and transfer force from said flange directly to said substrate through said projection.

2. The controller of claim 1, wherein said member comprises a central portion providing a pivot for said handle, an annular portion disposed concentrically about said central portion, a plurality of flexible connecting arms extending between and connecting said central portion and said annular portion permitting said annular portion to be tilted with respect to said central portion, said arms extending radially from said annular portion.

3. The controller of claim 2, wherein said flange has a lower depending ring adjacent the perimeter thereof subtending a lower surface, said ring positioned to engage said cantilevered arms, said annular portion having an upwardly extending surface adapted to be engaged by said lower surface of said flange and tilt said annular portion with respect to said central portion.

4. The controller of claim 2, wherein said central portion, said connecting arms, said annular portion, and said cantilevered arms are integrally formed.

5. The controller of claim 2, wherein said connecting arms are disposed so as to be angularly intermediate said contacts.

* * * * *